US007705261B1

(12) United States Patent
Chen et al.

(10) Patent No.: US 7,705,261 B1
(45) Date of Patent: Apr. 27, 2010

(54) PULL-ROTARY FILTER SWITCH

(76) Inventors: Chien-Hung Chen, 7F-2-3, No. 888, Jing Gwo Road, Taoyuan (TW); Tao-Lung Hsueh, 7F-2-3, No. 888, Jing Gwo Road, Taoyuan (TW)

( * ) Notice: Subject to any disclaimer, the term of this patent is extended or adjusted under 35 U.S.C. 154(b) by 0 days.

(21) Appl. No.: 12/416,974

(22) Filed: Apr. 2, 2009

(30) Foreign Application Priority Data

Feb. 9, 2009 (TW) ..... 98104013 A

(51) Int. Cl.
*H01H 13/62* (2006.01)

(52) U.S. Cl. ..... 200/566

(58) Field of Classification Search ..... 200/564–572
See application file for complete search history.

(56) References Cited

U.S. PATENT DOCUMENTS 4,724,286 A * 2/1988 Cummins ..... 200/4
5,384,442 A * 1/1995 Danner ..... 200/566
7,462,797 B2 * 12/2008 Wong et al. ..... 200/571
7,629,549 B2 * 12/2009 Huang et al. ..... 200/564
2009/0223796 A1 * 9/2009 Huang et al. ..... 200/336

* cited by examiner

*Primary Examiner*—Ross N Gushi
(74) *Attorney, Agent, or Firm*—IPFortune LLC; Ruay L. Ho

(57) ABSTRACT

A pull-rotary filter switch with a fool-proof effect to avoid accidentally cut off power supply includes a rotary switch device, a transmission line and a filter. The rotary switch device has a casing, a fixing seat, a substrate, a pull-rotary button and a contact terminal. The casing has an opening and a through hole. The fixing seat has a penetrating hole, a first eccentric hole and a second eccentric hole. The substrate has a conductive point and a board hole. The contact terminal is disposed on one end of the eccentric rod and contacted to the conductive point. The transmission line is electrically connected to the transmission line, which passes through the shaft hole, the penetrating hole, the board hole, and the through hole to electrically connect to the conductive point.

9 Claims, 11 Drawing Sheets

PULL-ROTARY FILTER SWITCH

FIELD OF THE INVENTION

The present invention relates to a pull-rotary filter switch and a method of using the same, in particular, to a pull-rotary filter switch in order to switch between two electrical conduction states.

DESCRIPTION OF RELATED ART

The state of an electronic device is usually changed by means of a switch. The most common switch is a two-stage switch for changing between a closed circuit and an open circuit. This kind of switch is operated by means of pressing or pushing. The switch at "press" engages with an elastic piece, so that the elastic force of the elastic piece is used to switch states between a closed circuit and an open circuit. When the switch at "push", two electrodes are electrically connected or disconnected via a pushing and sliding action.

However, the conventional switch has the drawback of large occurring friction. Since the switch of an electronic device may have to generate switching actions very frequently, the elastic piece and electrodes may become worn down from friction after a long period of usage. As a result, the switch action may become unreliable. Furthermore, a worn down switch cannot provide the user with a good operational feeling.

SUMMARY OF THE INVENTION

In view of the aforementioned issues, the present invention provides a pull-rotary filter switch. The present invention has a fool-proof effect in order to avoid the user to cut off the power supply easily by touching the pull-rotary button.

To achieve the above-mentioned objectives, the present invention provides a pull-rotary filter switch, including a rotary switch device, a transmission line, and a filter. The rotary switch device has a casing, a fixing seat, a substrate, a pull-rotary button and a contact terminal.

The casing has an opening and a through hole respectively formed on two opposite sides thereof, the fixing seat and the substrate is disposed in the casing, the fixing seat has a penetrating hole, a first eccentric hole and a second eccentric hole; the penetrating hole passes through a center portion of the fixing seat, and the first eccentric hole and the second eccentric hole both are eccentrically disposed beside the penetrating hole.

The substrate has a conductive point and a board hole passing therethrough; the pull-rotary button has a center shaft, an eccentric rod and a contact terminal; the center shaft has a shaft hole, the center shaft passes through the penetrating hole and the board hole; the eccentric rod is inserted in the first eccentric hole, and the contact terminal is disposed on one end of the eccentric rod and is contacted to the conductive point of the substrate.

The transmission line passes through the shaft hole, the penetrating hole, the board hole and the through hole in order to electrically connect to the conductive point of the substrate. The filter is electrically connected to the transmission line.

Therefore, the present invention has many advantages, for example, the eccentric rod is selectably inserted in the first eccentric hole or the second eccentric hole by pulling and rotating the pull-rotary button in order to electrically connect the contact terminal with the conductive point or prevent the contact terminal from being electrically connected to the conductive point. Hence, the present invention has a fool-proof effect in order to avoid the user to cut off the power supply easily by touching the pull-rotary button.

Further, the contact terminal is contacted to or separated from the substrate by moving upwards or downwards the contact terminal in order to decrease friction between the contact terminal and the substrate. Hence, the usage life of the rotary switch device is increased.

Furthermore, the present invention can be used to switch electrical conduction state by pulling and rotating the pull-rotary button. Hence, the operation of the present invention is easy with a better feeling.

In order to further understand the techniques, means and effects the present invention takes for achieving the prescribed objectives, the following detailed descriptions and appended drawings are hereby referred, such that, through which, the purposes, features and aspects of the present invention can be thoroughly and concretely appreciated; however, the appended drawings are merely provided for reference and illustration, without any intention to be used for limiting the present invention.

DETAILED DESCRIPTION OF THE PREFERRED EMBODIMENTS

Referring to FIGS. 1 to 10, the present invention provides a pull-rotary filter switch, including a rotary switch device 1 and a transmission line 2 and filter 3.

Figure 1:
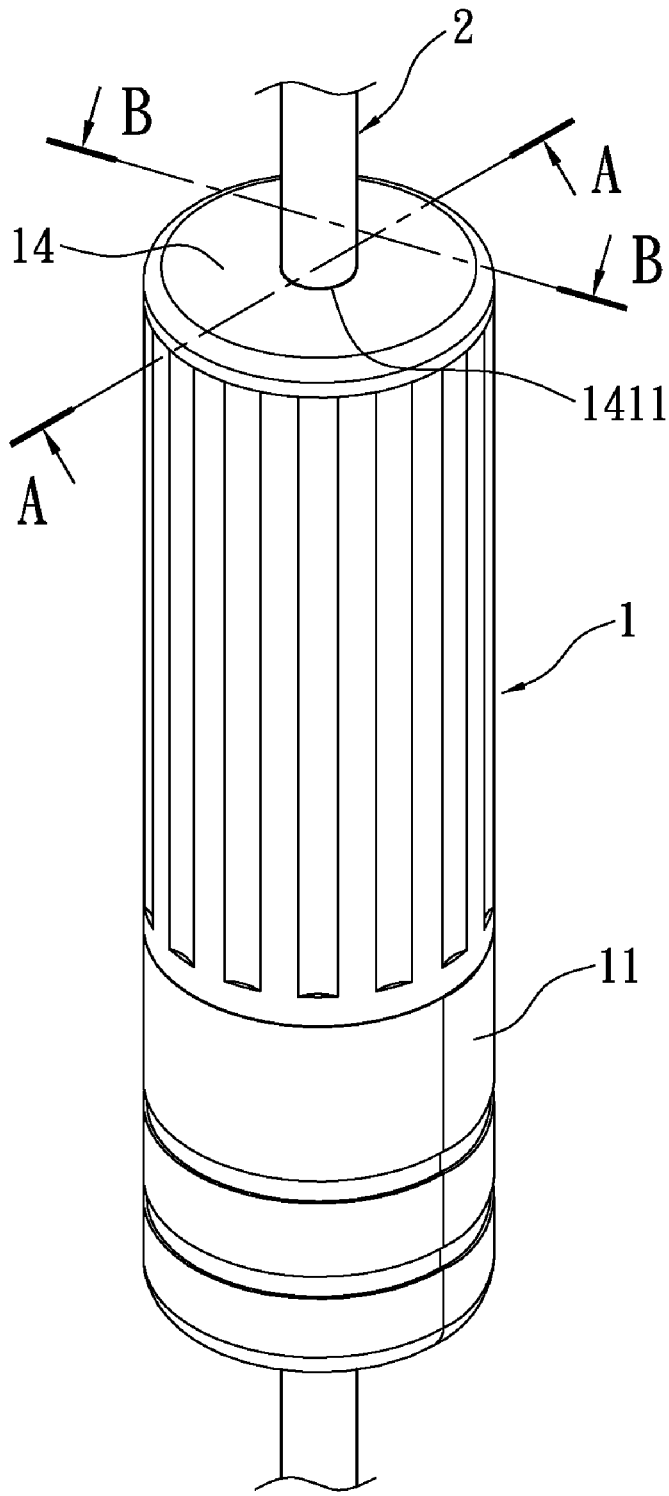
FIG. 1 is a perspective schematic view of the pull-rotary filter switch according to a preferred embodiment of the present invention.
Figure 6:
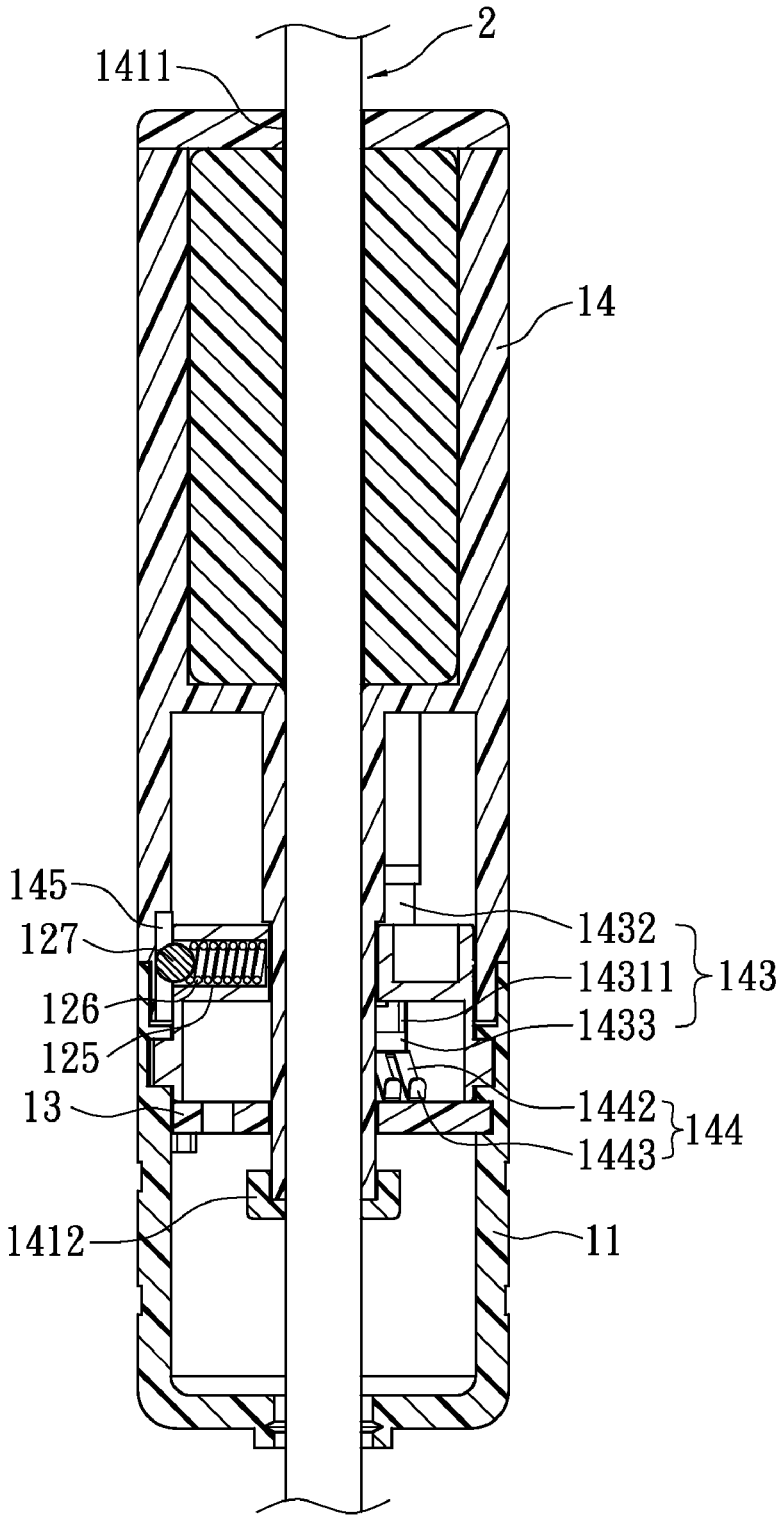
FIG. 6 is a cross-sectional view along line A-A of the pull-rotary filter switch shown in FIG. 1.

Now, referring to FIG. 1, the rotary switch device 1 is a tubular structure, and the rotary switch device 1 includes a casing 11 and a pull-rotary button 14 disposed on one side of the casing 11. The filter 3 is received in the casing 11 as shown in FIG. 6. The transmission line 2 passes through two sides of the rotary switch device 1 and is electrically connected to the filter 3. The transmission line 2 is electrically connected to a power and electric power provided by the power is transmitted to an electronic device through the filter 3.

Figure 2:
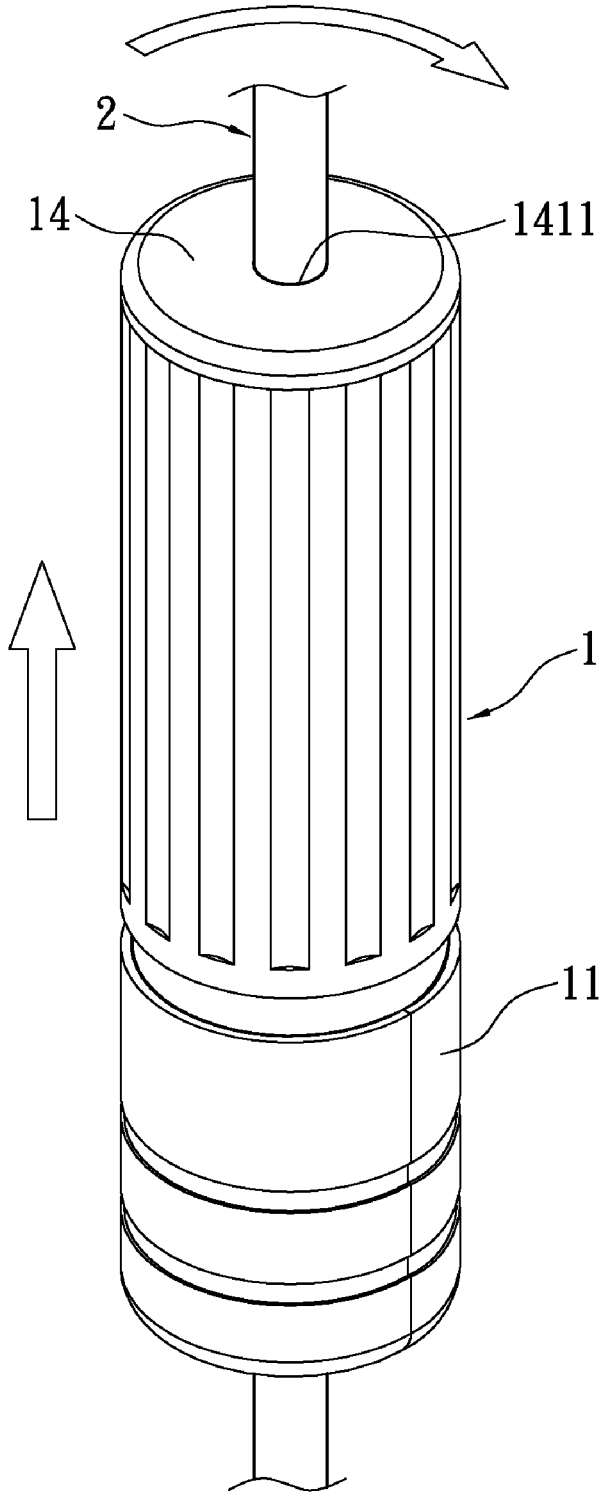
FIG. 2 is a perspective schematic view of the pull-rotary filter switch being pulled and rotated according to a preferred embodiment of the present invention.

Please referring to FIG. 2, the pull-rotary button 14 can be pulled upwards, rotated and pushed back by a user in order to switch electrical conduction state.

Figure 3:
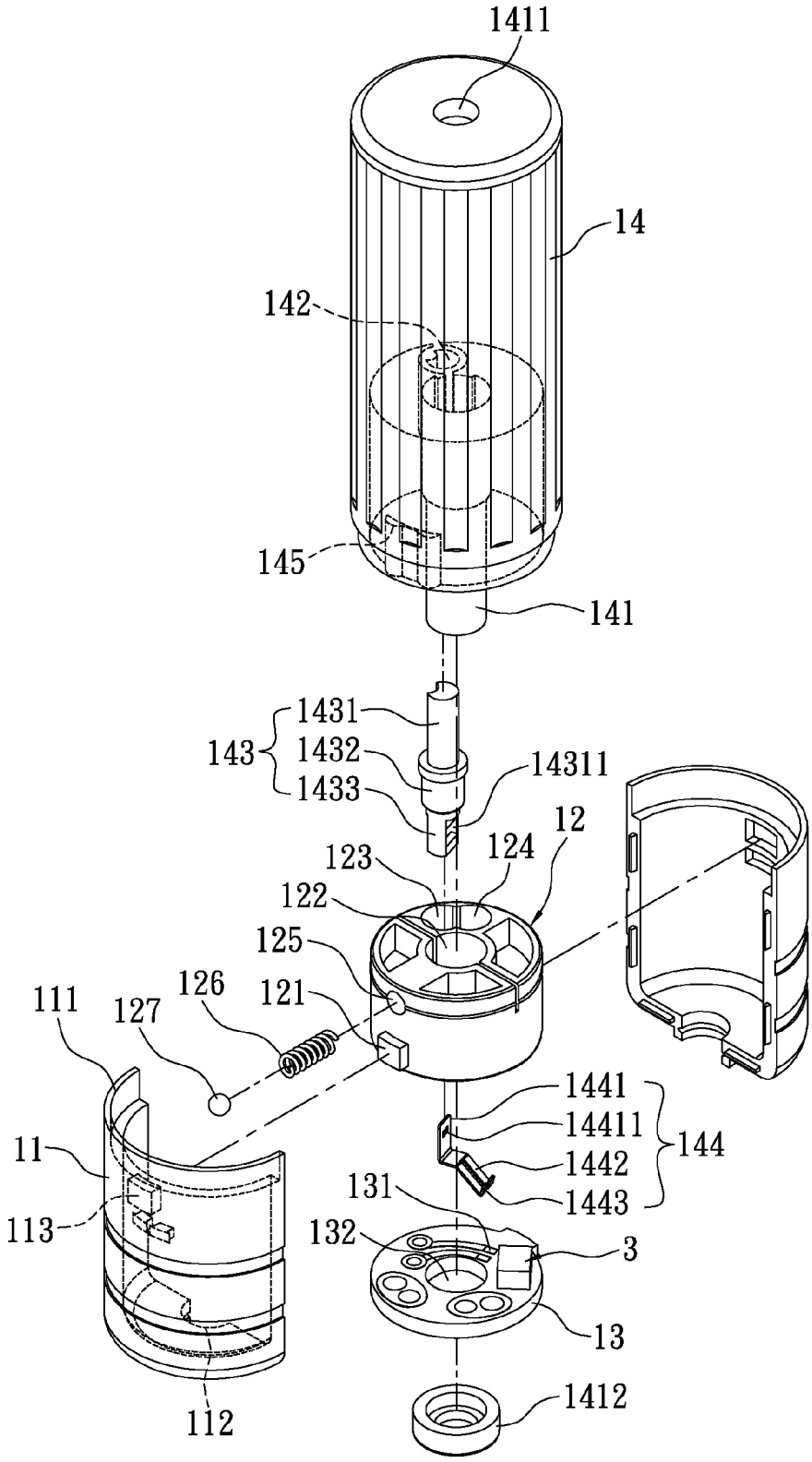
FIG. 3 is a perspective and exploded schematic view of the pull-rotary filter switch according to a preferred embodiment of the present invention.

Further, referring to FIG. 3, the rotary switch device 1 has a casing 11, a fixing seat 12, a substrate 13 and a pull-rotary button 14.

The casing 11 is a hollow tubular body that can be composed of two corresponding half casing. The casing 11 has an opening 111 and a circular through hole 112 sharing common space with the inner portion thereof and respectively formed on two opposite sides thereof. The casing 11 has two corresponding retaining grooves 113 formed on the inner portion thereof.

The fixing seat 12 has two retaining blocks 121, a penetrating hole 122, a first eccentric hole 123, a second eccentric hole 124, a ball hole 125, an elastic element 126 and a ball 127.

The fixing seat 12 is a tubular body that corresponds to the casing 11. The two retaining blocks 121 are oppositely disposed on an outer surface of the fixing seat 12 and are respectively retained in the retaining grooves 113 of the casing 11. The penetrating hole 122 passes through a center portion of the fixing seat 12. The first eccentric hole 123 and the second eccentric hole 124 both are eccentrically pass the fixing seat 12.

Specifically, the first eccentric hole 123 and the second eccentric hole 124 are parallel to each other with through space. The ball hole 125 is formed downwards from the outer surface of the fixing seat 12. The elastic element 126 can be a compression spring and is disposed in the ball hole 125. The ball 127 is disposed in the ball hole 125 and is abutted against one side of the elastic element 126.

The substrate 13 can be a printed circuit board (PCB) in circular shape, and the substrate 13 is disposed in the casing 11 and between one side of the through hole 112 and one side of the fixing seat 12. The substrate 13 has a conductive point 131 formed thereon and the conductive point 131 is electrically connected to the transmission line 2. The substrate 13 has a board hole 132 passing therethrough and corresponding to the penetrating hole 122.

In addition, the filter 3 is disposed on the substrate 13 and is electrically connected to the conductive point 131 and the transmission line 2. Therefore, the filter 3 can be applied to filter the signals transmitted from the transmission line 2. The transmission line 2 is electrically connected to the conductive point 131 of the substrate 13 by soldering or other similar means.

The pull-rotary button 14 has a center shaft 141, an eccentric sleeve 142, an eccentric rod 143, a contact terminal 144 and an arc groove 145.

The center shaft 141 is extended from a center of the pull-rotary button 14. The center shaft 141 has a shaft hole 1411 passing through the pull-rotary button 14. The center shaft 141 passes through the penetrating hole 122 of the fixing seat 12 and the board hole 132 of the substrate 13. Therefore, the common space of the shaft hole 1411, the penetrating hole 122 and the through hole 112 forms a passageway that passes through the pull-rotary button 14 and the casing 11. Hence, the transmission line 2 can pass through the rotary switch device 1 in order to electrically connect to the substrate 13.

The center shaft 141 has a stopping ring 1412 disposed on one side thereof and abutted against the substrate 13. When the pull-rotary button 14 is pulled upwards, the stopping ring 1412 can be applied to prevent the pull-rotary button 14 from separating the casing 11.

Figure 4:
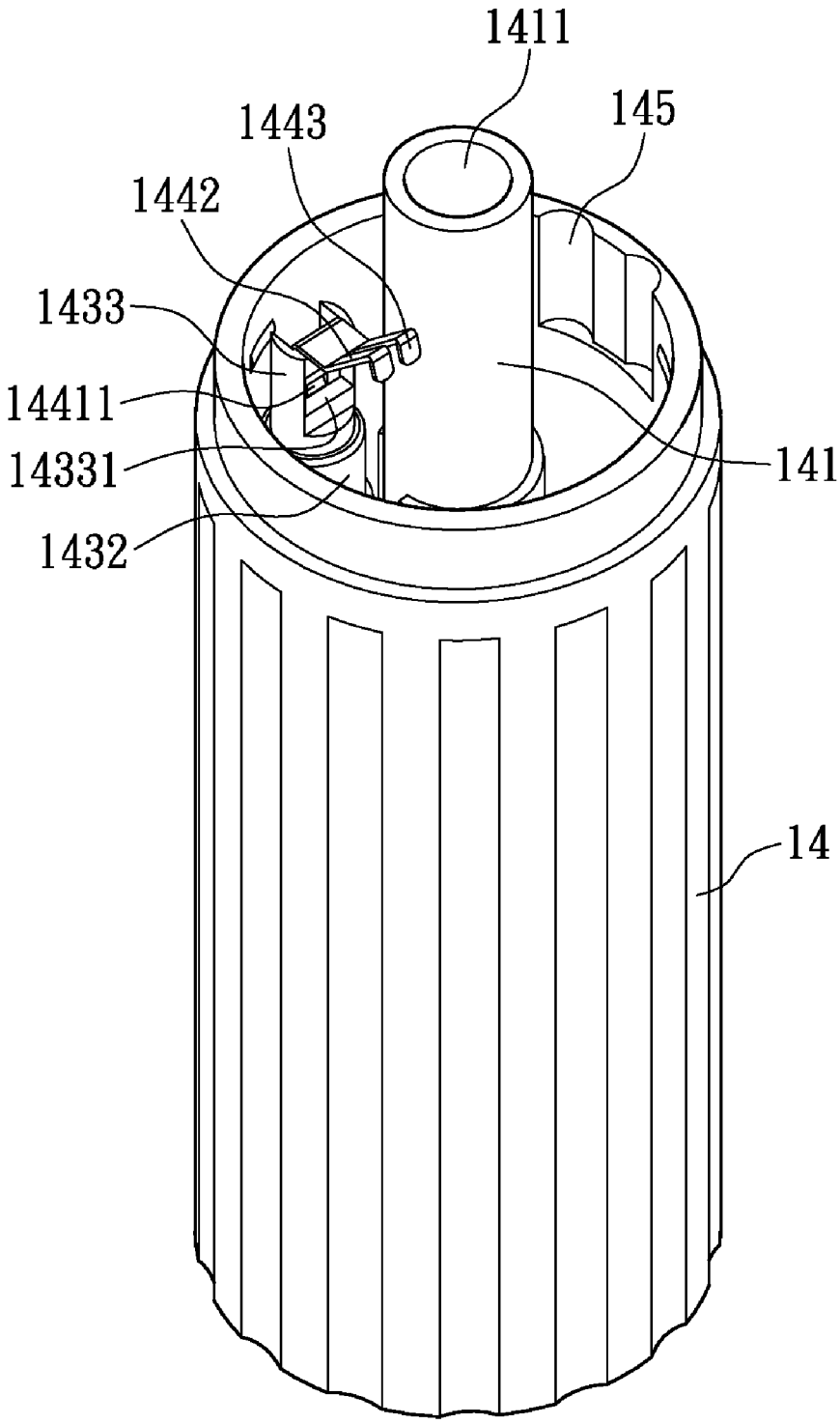
FIG. 4 is a perspective schematic view of the pull-rotary button of the pull-rotary filter switch according to a preferred embodiment of the present invention.

The eccentric sleeve 142 is eccentrically disposed in the pull-rotary button 14 and near the center shaft 141. The eccentric rod 143 has a sleeve rod 1431, an inserted rod 1432 and a connected tenon 1433 sequentially jointed to each other and they have different sizes. The sleeve rod 1431 is disposed in the eccentric sleeve 142, so that the sleeve rod 1431 is eccentrically disposed beside the center shaft 141 (as shown in FIG. 4). When the pull-rotary button 14 is rotated on the casing 11, the eccentric rod 143 can be rotated according to the center of the center shaft 141.

Figure 6A:
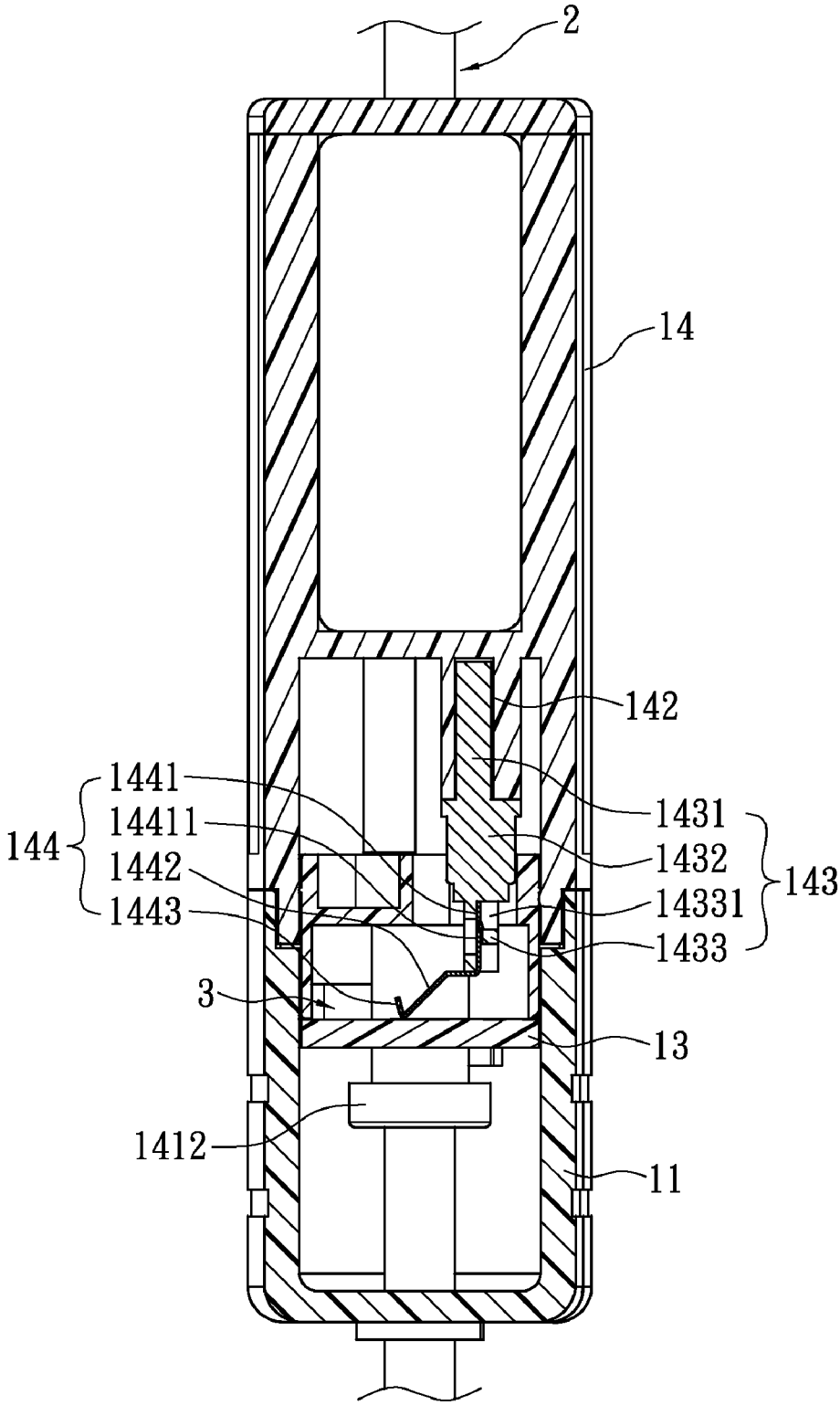
FIG. 6A is a cross-sectional view along line B-B of the pull-rotary filter switch shown in FIG. 2.

Referring to FIGS. 3 and 4, the inserted rod 1432 is mated with the first eccentric hole 123 and the second eccentric hole 124. When the inserted rod 1432 is inserted into the first eccentric hole 123 or the second eccentric hole 124, the connected tenon 1433 is projected outside the fixing seat 12 and near the substrate 13 (as shown in FIG. 6A). The size of the connected tenon 1433 is smaller than that of the first eccentric hole 123 or the second eccentric hole 124, and the connected tenon 1433 can be moved quickly between the first eccentric hole 123 and the second eccentric hole 124. The connected tenon 1433 has an embedded groove 14331 disposed thereon.

The contact terminal 144 has a fixing portion 1441, an elastic arm 1442 and a contact portion 1443. The fixing portion 1441 is a board structure and has an embedded board 14411 that is in the embedded groove 14331 of the connected tenon 1433. The elastic arm 1442 is extended obliquely from the fixing portion 1441. The contact portion 1443 is disposed on one end of the elastic arm 1442 in order to contact to the conductive point 131 of the substrate 13 (as shown in FIGS. 6A and 7).

Figure 5:
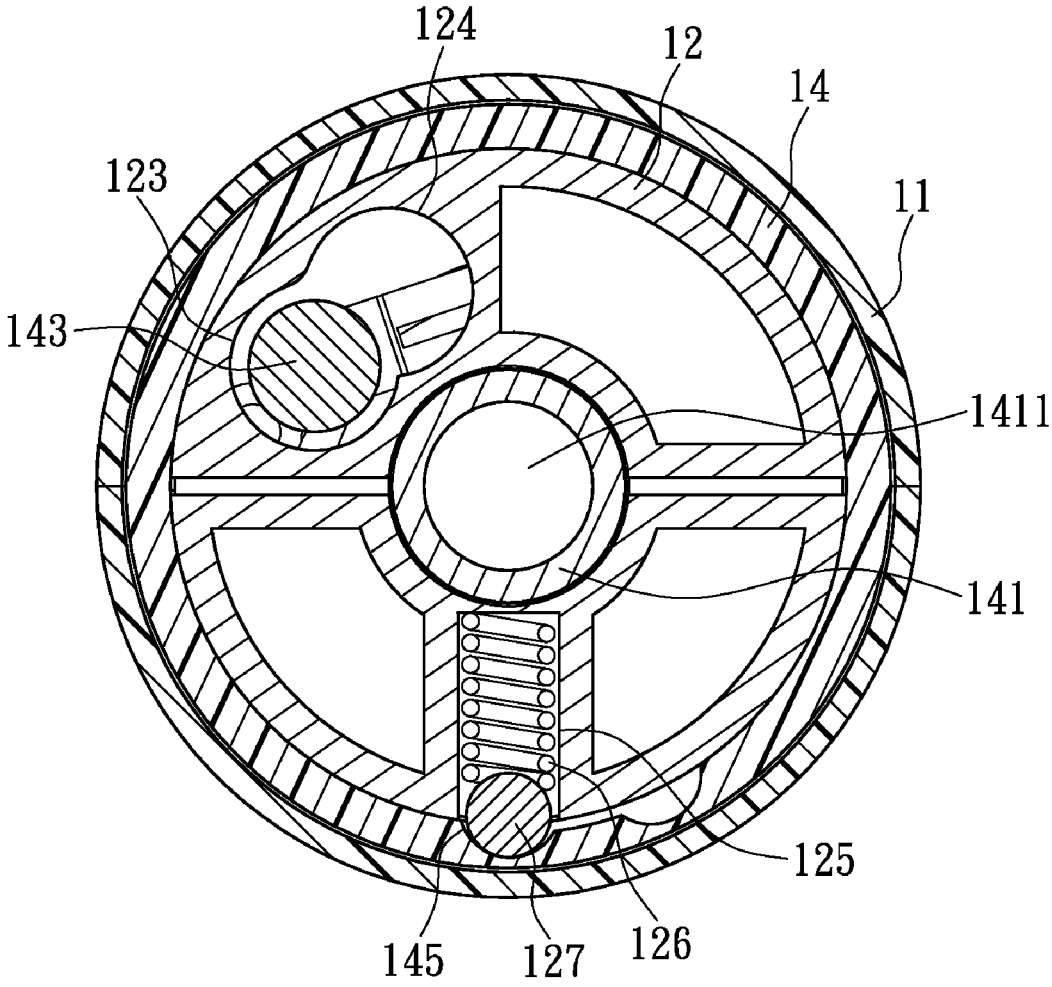
FIG. 5 is a transverse, cross-sectional, schematic view of the pull-rotary filter switch according to a preferred embodiment of the present invention.

Referring to FIG. 5, the pull-rotary button 14 has two arc grooves 145 formed on an inner surface thereof. The ball 127 is pressed in one of the arc grooves 145 by the elastic element 126. When the pull-rotary button 14 is rotated, the ball 127 is moved from one arc groove 145 to another arc groove 145 in order to provide multi-switch hand feeling.

Figure 7:
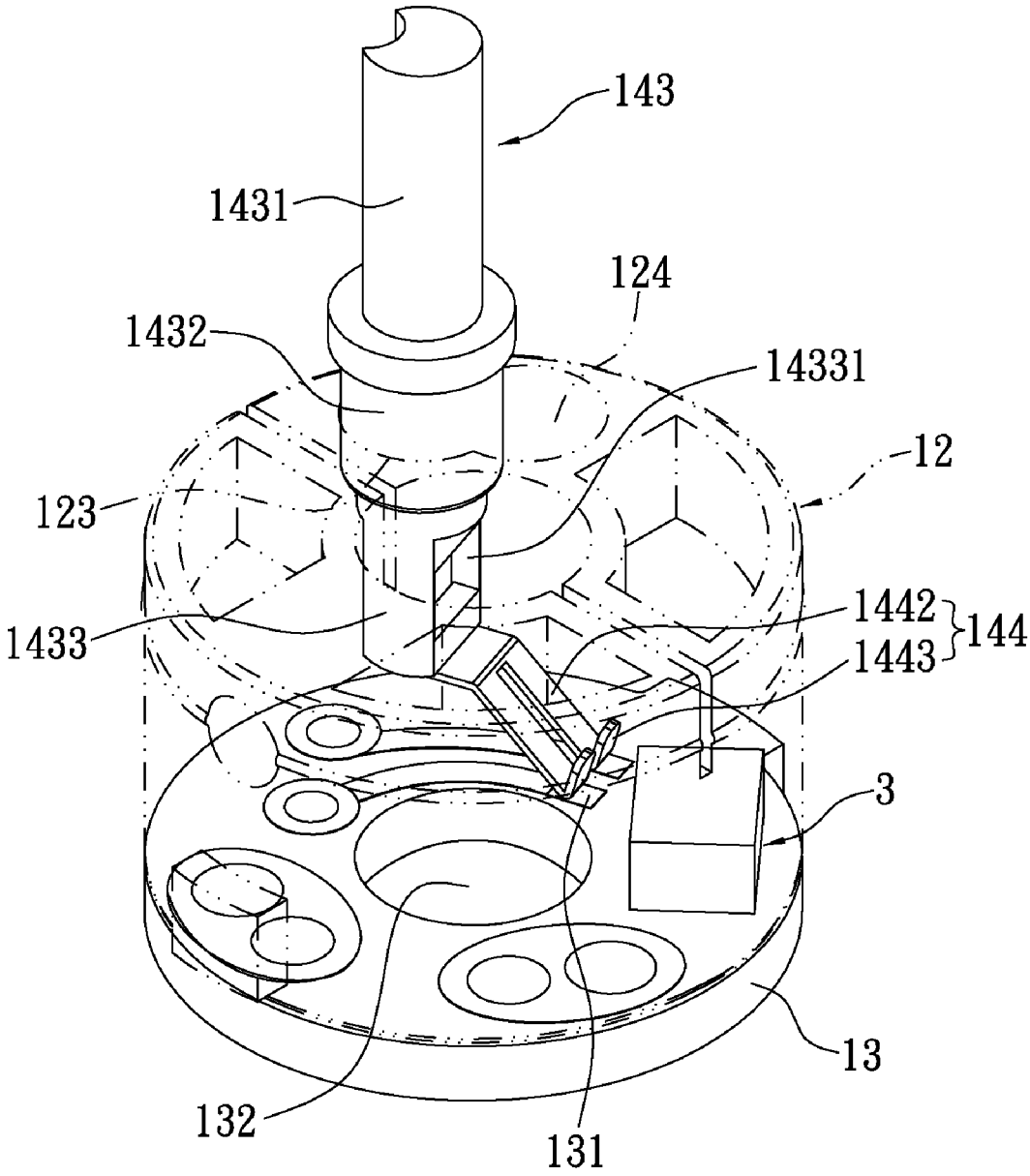
FIG. 7 is a schematic view of the first-type operation of the pull-rotary filter switch according to a preferred embodiment of the present invention.

Referring to FIG. 7, when the eccentric rod 143 is inserted into the first eccentric hole 123 and the contact portion 1443 of the contact terminal 144 contacts to the conductive point 131 of the substrate 13, the transmission line 2 is electrically connected to the rotary switch device 1 and the signals generated from the transmission line 2 can be filtered by the filter 3 (as shown in FIG. 1).

Figure 8:
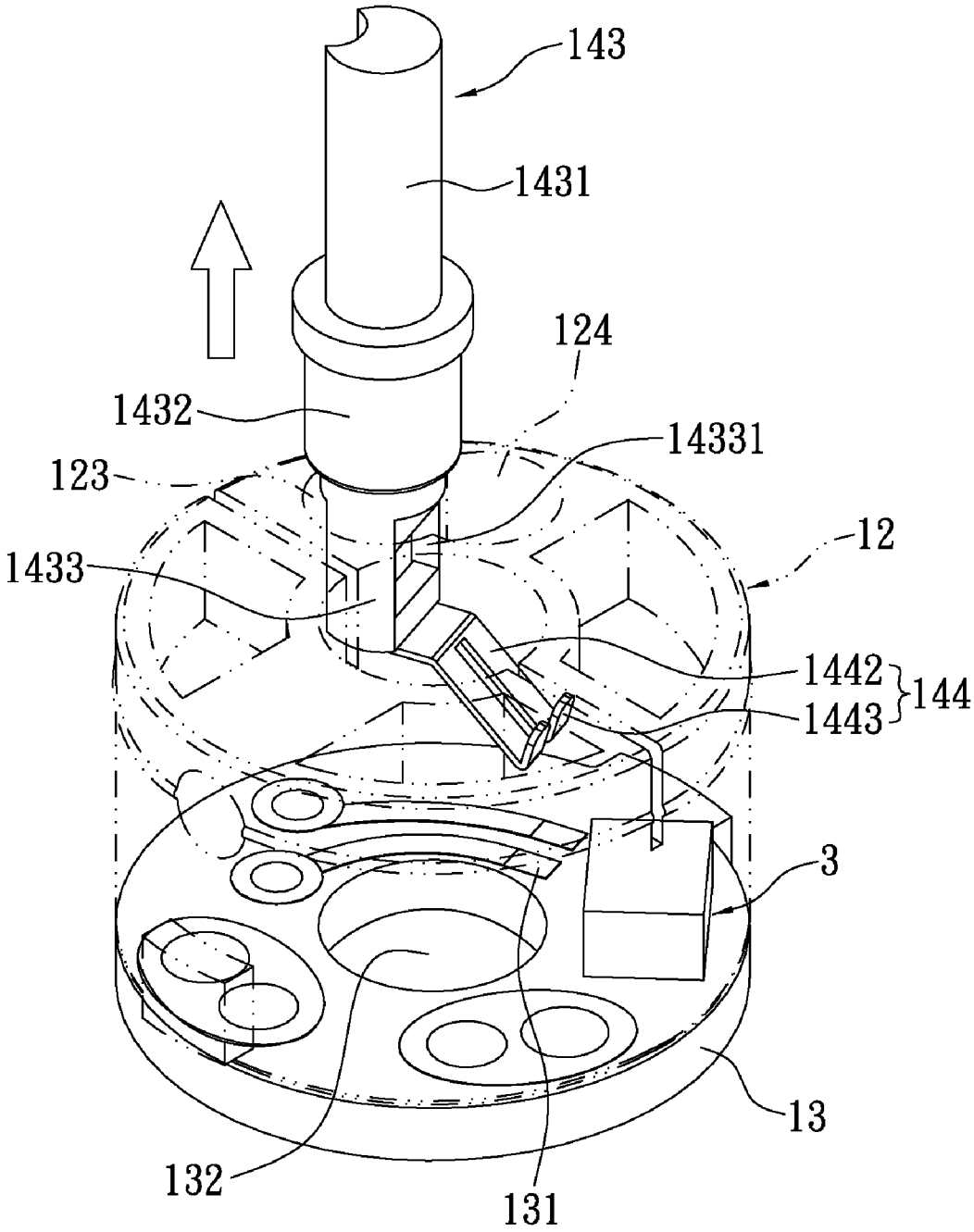
FIG. 8 is a schematic view of the second-type operation of the pull-rotary filter switch according to a preferred embodiment of the present invention.
Figure 9:
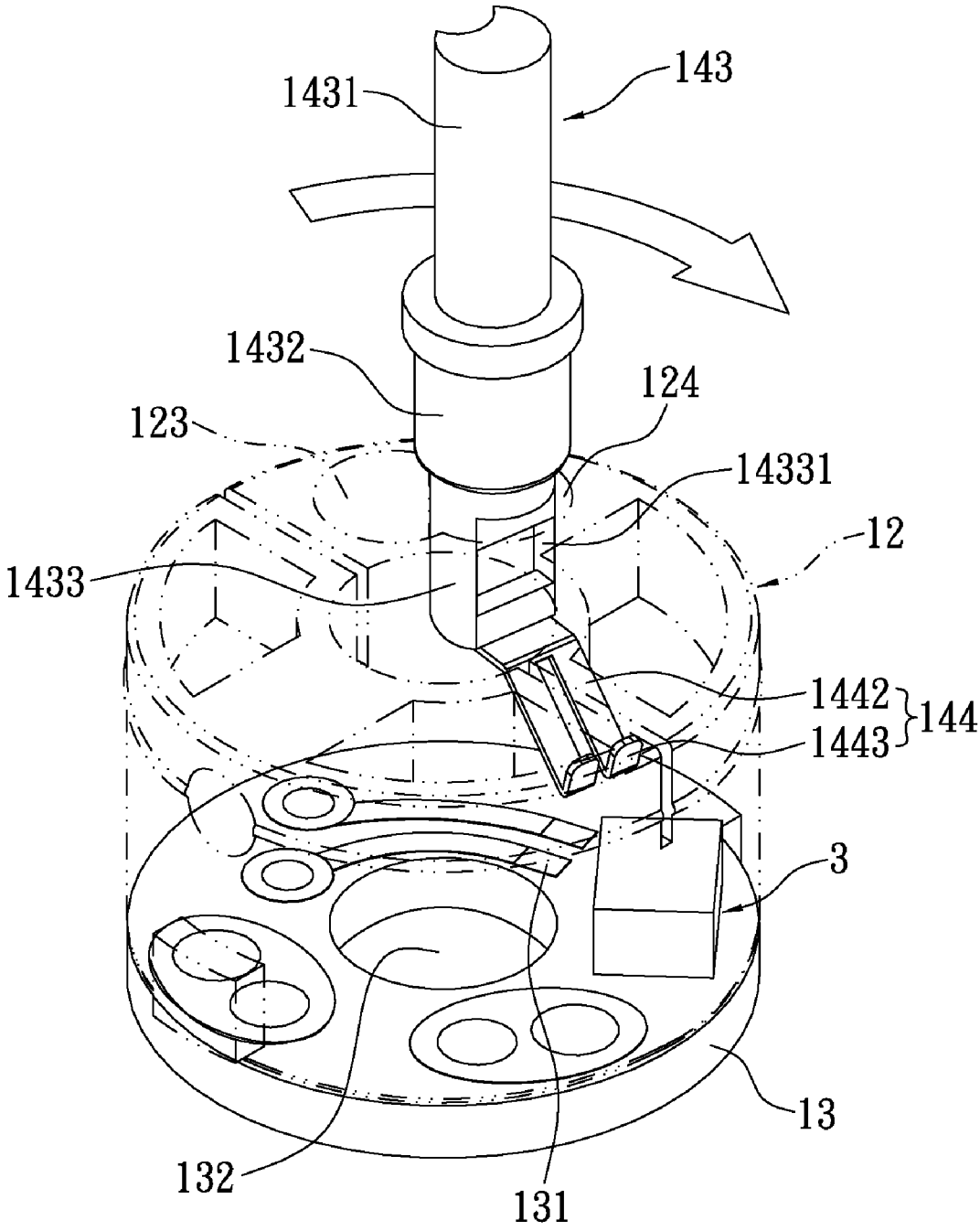
FIG. 9 is a schematic view of the third-type operation of the pull-rotary filter switch according to a preferred embodiment of the present invention.

Referring to FIG. 8, when the pull-rotary button 14 is pulled upwards, the connected tenon 1433 of the eccentric rod 143 is received in the first eccentric hole 123 and the contact portion 1443 of the contact terminal 144 is separated from the conductive point 131. Now, referring to FIG. 9, when the pull-rotary button 14 is rotated to drive the eccentric rod 143 to rotate, the connected tenon 1433 is moved from the first eccentric hole 123 to the second eccentric hole 124.

Figure 10:
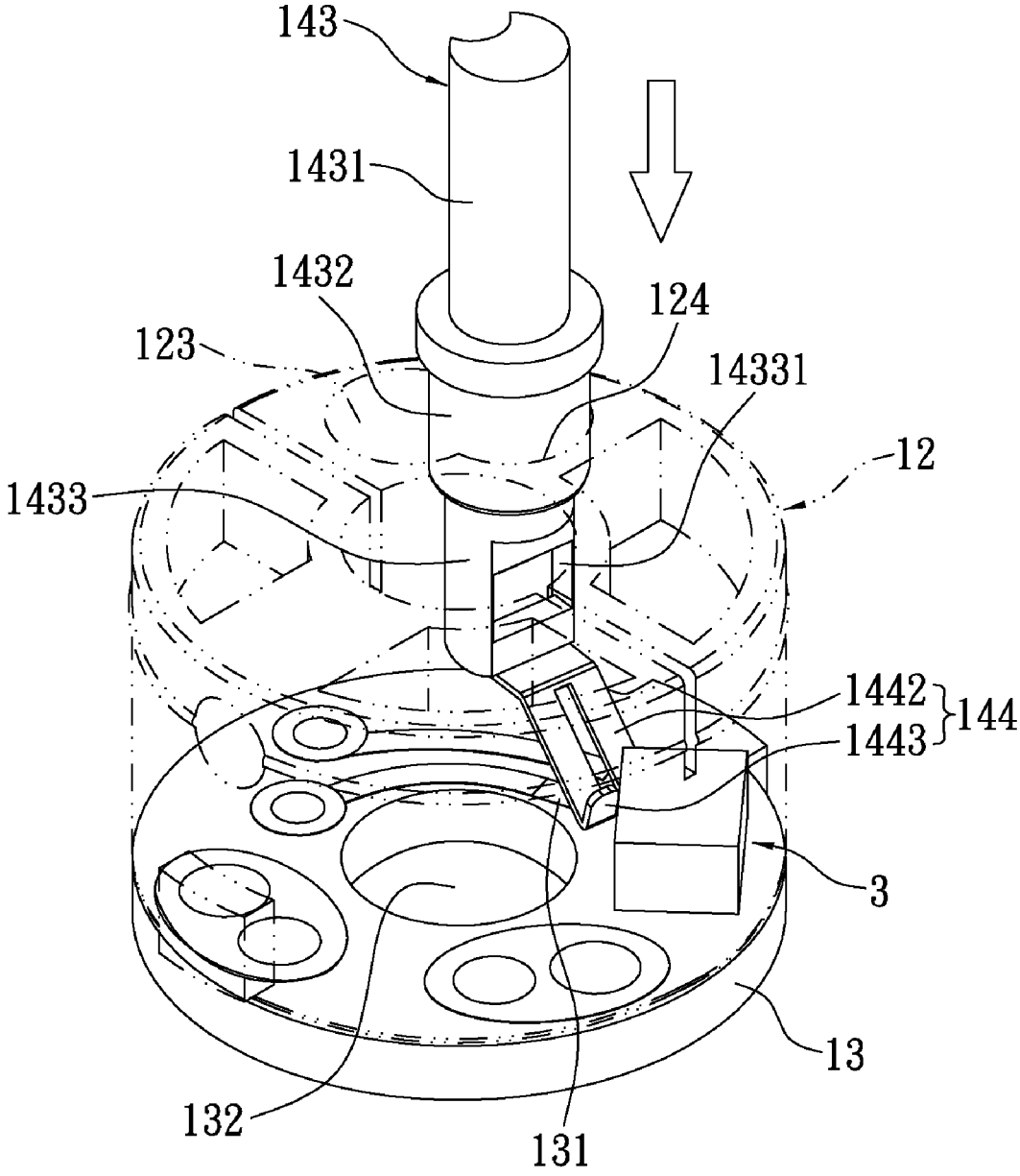
FIG. 10 is a fourth-type operation, schematic view of the pull-rotary filter switch according to a preferred embodiment of the present invention.

Further, referring to FIG. 10, when the pull-rotary button 14 is pushed back, the inserted rod 1432 is inserted in the second eccentric hole 124 in order to prevent the contact portion 1443 of the contact terminal 144 from being electrically connected to the conductive point 131. Hence, a foolproof effect can be achieved.

In conclusion, the present invention has many advantages. For example, the eccentric rod 143 is selectably inserted in the first eccentric hole 123 or the second eccentric hole 124 by pulling and rotating the pull-rotary button 14 in order to electrically connect the contact terminal 144 with the conductive point 131 or prevent the contact terminal 144 from being electrically connected to the conductive point 131. Hence, the present invention has a fool-proof effect in order to avoid the user to cut off the power supply easily by touching the pull-rotary button 14.

Furthermore, the contact terminal 144 is contacted to or separated from the substrate 13 by moving upwards or downwards the contact terminal 144 in order to decrease the friction between the contact terminal 144 and the substrate 13. Hence, the usage life time of the rotary switch device 1 is increased.

Moreover, the present invention can be used to switch electrical conduction state by pulling and rotating the pull-rotary button 14. Hence, the operation of the present invention is easy with a better feeling.

The above-mentioned descriptions represent merely a preferred embodiment of the present invention, without any intention to limit the scope of the present invention thereto. Various equivalent changes, alternations or modifications based on the claims of present invention are all consequently viewed as being embraced by the scope of the present invention.

What is claimed is:

1. A pull-rotary filter switch, comprising:

a rotary switch device having a casing, a fixing seat, a substrate, a pull-rotary button and a contact terminal, wherein the casing has an opening and a through hole respectively formed on two opposite sides thereof, the fixing seat and the substrate is disposed in the casing, the fixing seat has a penetrating hole, a first eccentric hole and a second eccentric hole, the penetrating hole passes through a center portion of the fixing seat, the first eccentric hole and the second eccentric hole both are eccentrically disposed beside the penetrating hole, the substrate has a conductive point and a board hole passing therethrough, the pull-rotary button has a center shaft, an eccentric rod inserted in the first eccentric hole and a contact terminal, the center shaft passing through the penetrating hole and the board hole has a shaft hole, and the contact terminal is disposed on one end of the eccentric rod and is contacted to the conductive point of the substrate;

a transmission line passing through the shaft hole, the penetrating hole, the board hole and the through hole in order to electrically connect to the conductive point of the substrate; and a filter electrically connected to the transmission line.

2. The pull-rotary filter switch as claimed in claim 1, wherein the first eccentric hole and the second eccentric hole are parallel to each other and share common space.

3. The pull-rotary filter switch as claimed in claim 1, wherein the casing has two retaining grooves formed on the inner portion thereof; and the fixing seat has two retaining blocks oppositely disposed on an outer surface thereof and respectively retained in the two retaining grooves.

4. The pull-rotary filter switch as claimed in claim 1, wherein the fixing seat has a ball hole, an elastic element and a ball; the ball hole is formed downwards from the outer surface of the fixing seat; the elastic element is disposed in the ball hole; the ball is abutted against one side of the elastic element; the pull-rotary button has two arc grooves formed on an inner surface thereof; and the ball is pressed in one of the arc grooves.

5. The pull-rotary filter switch as claimed in claim 4, wherein the elastic element is a compression spring.

6. The pull-rotary filter switch as claimed in claim 1, wherein the center shaft has a stopping ring disposed on one side thereof and abutted against the substrate.

7. The pull-rotary filter switch as claimed in claim 1, wherein the filter is disposed on the substrate and electrically connected to the conductive point.

8. The pull-rotary filter switch as claimed in claim 1, wherein the eccentric rod has a connected tenon; the connected tenon has an embedded groove; the contact terminal has a fixing portion, an elastic arm and a contact portion; the fixing portion has an embedded board embedded in the embedded groove; the elastic arm is extended obliquely from the fixing portion; and the contact portion is disposed on one end of the elastic arm in order to contact the conductive point of the substrate.

9. The pull-rotary filter switch as claimed in claim 8, wherein the pull-rotary button has an eccentric sleeve; the eccentric rod has a sleeve rod; and the sleeve rod is disposed in the eccentric sleeve.

* * * * *